United States Patent [19]

Decker

[11] Patent Number: 5,070,314

[45] Date of Patent: Dec. 3, 1991

[54] HERMETIC MODULE CONTAINING MICROWAVE COMPONENT

[75] Inventor: Frank Decker, Barto, Pa.

[73] Assignee: UTI Corporation, Collegeville, Pa.

[21] Appl. No.: 526,345

[22] Filed: May 21, 1990

[51] Int. Cl.[5] ..... H01P 1/04

[52] U.S. Cl. ..... 333/260; 439/581

[58] Field of Search ..... 333/33, 260; 439/578, 439/581

[56] References Cited

U.S. PATENT DOCUMENTS

| | | | |
|---|---|---|---|
| 2,449,073 | 9/1948 | Johannesen | 333/260 X |
| 4,161,704 | 7/1979 | Schafer | 333/33 |
| 4,266,207 | 5/1981 | Schafer | 333/206 |
| 4,486,726 | 12/1984 | Schafer | 333/260 |

*Primary Examiner*—Paul Gensler

*Attorney, Agent, or Firm*—Seidel, Gonda, Lavorgna & Monaco

[57] ABSTRACT

A hermetic module for containing at least one electronic component is integrated into a coaxial cable having a center conductor and an outer conductor. A housing defines an opening and an interior space therein. A body member is disposed within the interior space of the housing and defines a recess and a cavity adapted to contain the electronic component. The recess is in registration with the opening in the housing and is adapted to form an electrical contact with the outer conductor of the coaxial cable. A conductor member is disposed between the recess and the cavity, and includes a first end adapted to mate with the center conductor of the coaxial cable when the coaxial cable is inserted into the recess of the body member, and a second end disposed within the cavity. A sealing member disposed around the conductor member forms a seal between the recess and the cavity.

6 Claims, 2 Drawing Sheets

FIG. 1
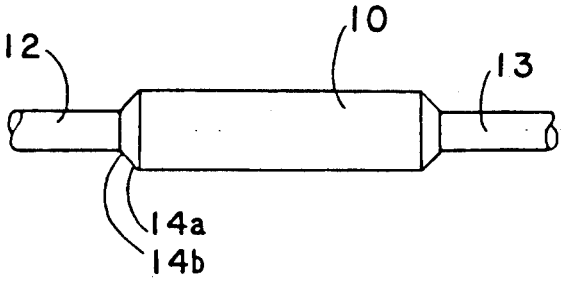
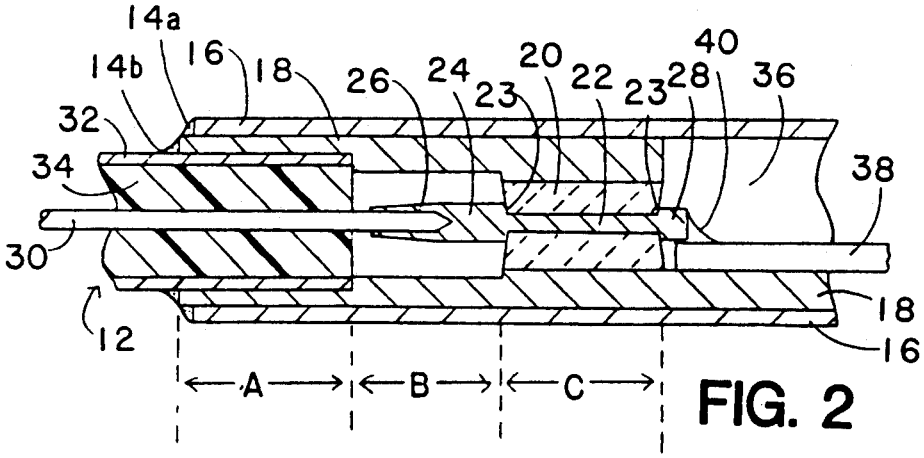
FIG. 2
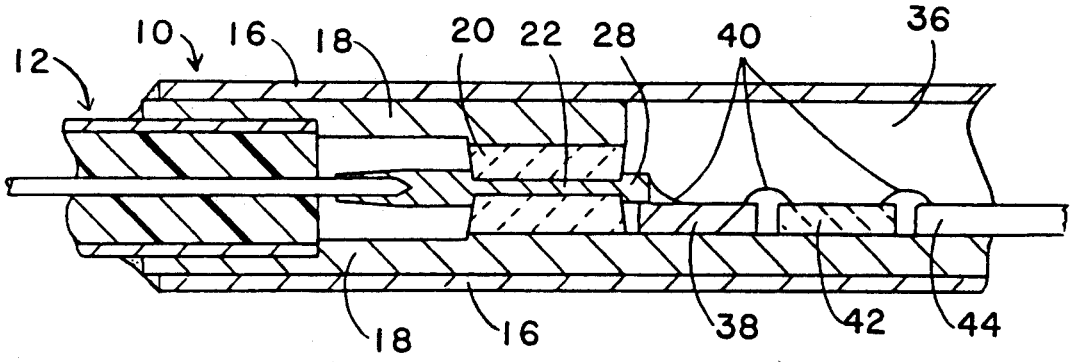
FIG. 3

FIG. 4
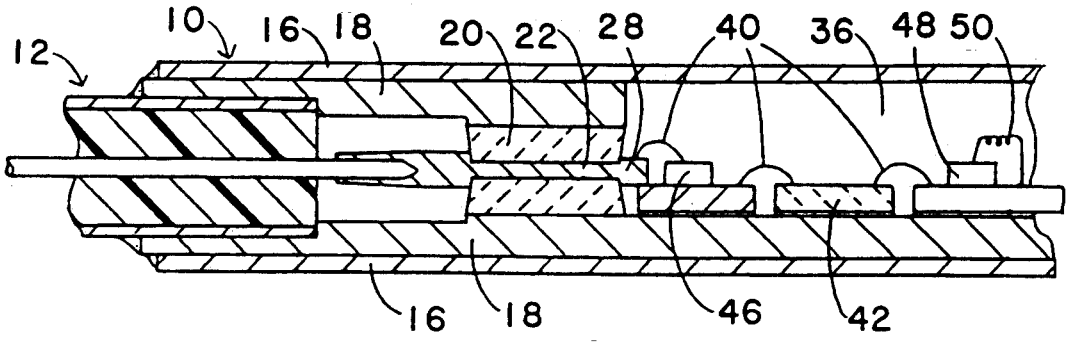
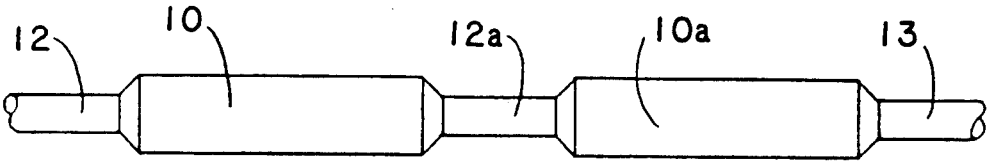
FIG. 5
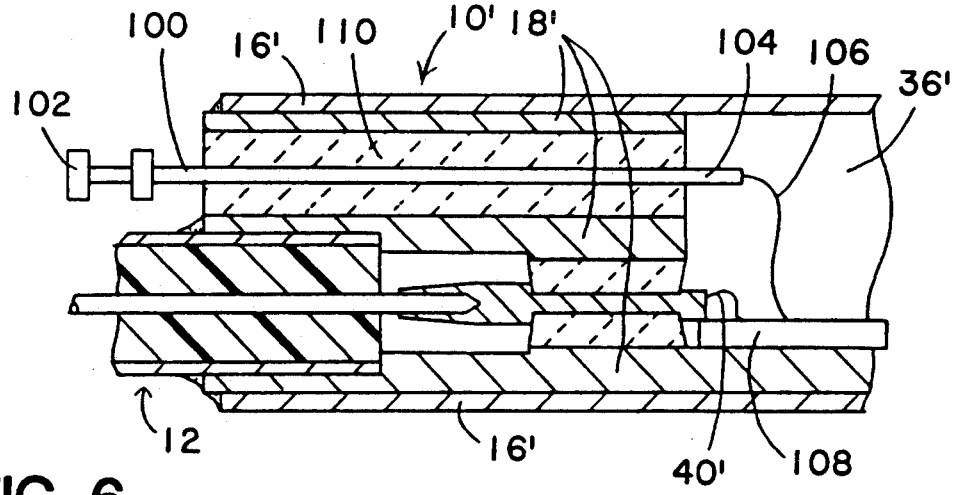
FIG. 6

HERMETIC MODULE CONTAINING MICROWAVE COMPONENT

FIELD OF THE INVENTION

The present invention is directed to a hermetic module having circuit components disposed therein, adapted to be integrated into a coaxial cable for a microwave transmission line.

BACKGROUND OF THE INVENTION

Microwave transmission lines are well known and often take the form of a flexible or semi-rigid coaxial cable. U.S. Pat. Nos. 4,161,704 and 4,486,726 disclose modules with circuit components disposed therein, which are disposed along coaxial cables. As noted in the '704 patent, a typical outer diameter range of the coaxial cable is 0.034–0.250 inches. If the transverse dimensions of the circuit component within the module greatly exceed the outer diameter of the coaxial cable, the component cannot be integrated into the cable.

It has been conventional to provide a threaded connector between one end of the cable and one end of such components. Threaded connectors on components such as attenuators can have transverse dimensions greater than those of the attenuator itself. Threaded connectors increase the length and weight of the microwave component and constitute areas for potential losses.

It is also known that there are several important requirements that an interface between a coaxial cable and circuit component must satisfy. The connector or connectorless joint must present a constant characteristic impedance, must have controlled compensation of electrical discontinuities resulting from unavoidable dimensional changes, must meet close mechanical dimensional tolerances, and must not introduce reflections in the microwave transmission line.

Further, it is often important that microwave components be placed within a hermetically sealed module, so that the sensitive electronic components will not be damaged in a non-hermetic environment. A typical standard for the effectiveness of a hermetic seal is defined in MIL-STD-883, Method 1014.5.

Electronic components disposed in modules along microwave transmission lines may also be subject to mechanical stresses. It is therefore preferable that the conductive members disposed between the coaxial cable and the electronic components in the module be "captivated" so that stresses on the coaxial cable will not be transmitted to and affect the mechanical integrity of the module or the electronic components in it.

It is an object of the present invention to provide a connectorless joint between a coaxial cable and a module containing microwave components which meets the requirements for mechanical strength, dimensional tolerances, and constant characteristic impedance for such joints.

Another object of the invention is to eliminate a space constraint in densely populated systems by providing a means of integrating active and passive electronic components into the same space occupied by a cable assembly.

It is another object of the invention to provide a means of adding a component into the space occupied by an existing cable assembly in a configured system when modification or upgrade is required.

It is another object of this invention to provide a hermetically sealed housing integrated in a coaxial cable assembly for the purpose of providing hermetic protection to sensitive electronic components.

SUMMARY OF THE INVENTION

The present invention is a hermetic module for containing at least one electronic component, integrated into a coaxial cable having a center conductor and an outer conductor. A housing defines an opening and an interior space therein. A body member is disposed within the interior space of the housing and defines a recess and a cavity. The recess is in registration with the opening in the housing and is adapted to receive an end of the coaxial cable. The interior walls of the recess from an electrical contact for the outer conductor. The cavity is adapted to contain the electronic component. A conductor member is disposed between the recess and the cavity, and includes a first end adapted to receive the center conductor of the coaxial cable when the coaxial cable is inserted into the recess of the body member, and a second end disposed within the cavity. A sealing member disposed around the conductor member forms a seal between the recess and the cavity.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a general view of a hermetic module of the present invention integrated with a coaxial cable.

FIG. 2 is a partial cross-sectional view of the present invention, as viewed through line 2—2 of FIG. 1.

FIG. 3 is a cross-sectional view of an alternate embodiment of the present invention.

FIG. 4 is a cross-sectional view of another alternate embodiment of the present invention.

FIG. 5 is a general view of a plurality of modules of the present invention, connected in series.

FIG. 6 is a cross-sectional view of another embodiment of the present invention, illustrating a bias feedthrough.

DETAILED DESCRIPTION OF THE INVENTION

In the drawings, wherein like numerals indicate like elements, FIG. 1 shows a general external view of a hermetic module 10 of the present invention in a typical configuration integrated with a coaxial cable for microwave transmission. Hermetic module 10 contains at least one electronic component therein, and is joined at one end to coaxial cable 12. Hermetic module 10 may also be connected at its other end to a second coaxial cable 13. It is likely that the size of the electronic components within module 10 may require module 10 to have an outer diameter slightly larger than that of the coaxial cable. Metallurgical joints 14*a* and 14*b* join the module 10 to coaxial cables 12 and 13 and form a hermetic seal.

FIG. 2 is a partial cross-sectional view of the module and cables in FIG. 1, and illustrates the end of the coaxial cable 12 inserted into one end of hermetic module 10. (In the preferred embodiment shown generally in FIG. 1, similar structure accepts coaxial cable 13 at the opposite end of module 10.) Hermetic module 10 and coaxial cable 12 form a connectorless joint. On the outer surface of module 10 is a generally tubular cover 16. The cover 16 serves as a housing for the other components in the module. Disposed around the interior surface of the cover 16 is the body 18. Body 18 is of a conductive material and forms a recess in the form of an axial bore in registration with the opening of the cover 16, and forms with the cover 16 an inner cavity 36. Inner cavity 36 contains the electronic components in the module, as will be explained below. The metallurgical joint 14*a* interconnects the cover 16 and body 18 to form a hermetic seal around the inner cavity 36. The metallurgical joint 14*b* interconnects the body 18 to cable 12. (Another metallurgical joint similarly connects body 18 to cable 13 on the other end of module 10, not shown.)

Within the axial bore in the body 18 is disposed a ceramic or glass bead 20. Bead 20 forms a hermetic seal for cavity 36, as described below.

Embedded within the glass bead 20, along the central axis of the module 10, is a conductor member 22. At the end of the conductor member 22 facing the coaxial cable 12 is a female receptacle 24 having a center recess 26, which is adapted to receive the center conductor 30 of the coaxial cable 12, as will be explained below. At the opposite end of conductor member 22 is a terminal end 28. The glass bead 20 is fused to the surface of conductor member 22 and the axial bore in body 18 to form a restraining interface and hermetic seal. The conductor member 22 forms inward-facing shoulders 23 against the ends of the glass bead 20. In this way, the glass bead 20 engages the inward-facing shoulders to restrain the conductor member 22 against movement along the axis of the module 10 when any part of the module is subjected to mechanical stress. When the motion of the conductor member 22 relative to the other parts in the module 10 is thus restrained, it is said that the conductor member is "captivated".

The coaxial cable 12 which is inserted into the end of the module 10 may be of any type of coaxial cable. Typically, a coaxial cable 12 includes a center conductor 30, an outer conductor 32, and an insulating layer 34 disposed between the center conductor 30 and the outer conductor 32. To connect the end of the coaxial cable 12 with the female receptacle 24 of the conductor member 22, outer conductor 32 and insulating layer 34 of the coaxial cable 12 are removed in well-known manner to expose a length of the center conductor 30. Coaxial cable 12 is inserted into the body of the module 10, and is engaged by the axial bore in the body 18, so that outer conductor 32 is in electrical contact with body 18. The exposed length of center conductor 30 at the end of coaxial cable 12 fits into the female receptacle 24 when the coaxial cable 12 is inserted into the body 18 of the module 10. The center conductor 30 may be tapered at its end, as shown, to facilitate easy insertion into the female receptacle 24.

The axial bore in the body 18 is preferably formed in three regions, designated in FIG. 2 as A, B, and C, each having a different inner diameter and forming shoulders therebetween. Region A, the outermost portion of the axial bore, is of a diameter just large enough to accommodate the body of the coaxial cable 12 and form a contact with the outer conductor 32, as shown. Region B has a slightly smaller inner diameter so as to form a shoulder between region A and region B. This shoulder acts to limit the extent of insertion of coaxial cable 12 into module 10. Region C has a still smaller inner diameter and provides a surface for the hermetic seal of the glass bead 20. These regions of different diameters may be formed in the dielectric body 18 through known means, such as drilling or molding.

In many situations it is desirable to design module 10 of the present invention to have a known and predetermined characteristic impedance, so that a circuit designer using the module may take the impedance of the joint itself into account in designing a circuit. The characteristic impedance of the joint between the coaxial cable and module 10 is dependent on the dimensions of the axial bore in body 18 in the area around the female receptacle 24 of the conductor member 22, shown as region B in FIG. 2. In region B, the mated female receptacle outside diameter and corresponding body inside diameter form an air dielectric coaxial transmission line having a predetermined impedance. By varying the diameters of region B and the female receptacle 24, the module 10 may be designed to have a predetermined characteristic impedance. This predetermined impedance can be taken into account when the module 10 is incorporated in a microwave circuit.

Interior of module 10 is a cavity 36 defined by the cover 16 and body 18, in which electronic components, such as that shown by 38 in FIG. 2, may be disposed. Each electronic component may be operatively connected to the terminal end 28 of conductor member 22 by wire bonding 40, or other means. The electronic components are preferably designed to have a first surface having terminals for inputs and outputs, and a second surface opposite the first surface which is intended to be connected to ground. Because body 18 is conductive, and typically forms a connection with the outer conductor 32 of the coaxial cable 12 (which typically is the connection to ground), the components within the inner cavity 36 are arranged so that their surfaces associated with ground are attached to the body member 18 while their functional surfaces may be readily connected to the terminal end 28 of conductor member 22. In a module 10 having conductor members 22 at both ends, the components may be connected in a functional closed circuit fashion between the center conductors 32 of the coaxial cables 12 and 13.

When the coaxial cable 12 is inserted into the module 10, electrical connections are formed between the center conductor 30 of the coaxial cable 12 through the conductor member 22, and through the electronic components in the cavity 36. Another electrical connection is formed between the outer conductor 32 of coaxial cable 12 and the conductive body member 18. It is typical, but not necessary, that the outer conductor 32 of the coaxial cable 12 be the connection to ground. It is conceivable that electronic components contained within the cavity 36 may be operatively connected to the outer conductor 32 by way of body member 18, as well as through the center conductor 30 and the conductor member 22. The glass bead 20 serves not only as a hermetic seal between the cavity 36 and the recess in the body 18, but also serves as an electrical insulator between the conductor member 22 and the body 18.

FIGS. 3 and 4 illustrate variations of the present invention having multiple electronic components within the cavity 36 to perform various functions. In FIG. 3 is shown an embodiment wherein the cavity 36 contains a number of electronic components 38, 42, and 44, arranged in series and connected by wire bonding 40, to form an amplifier. In this case, parts 38 and 44 are resistors and component 42 is a monolithic amplifier device. In FIG. 4 is shown a hermetic module containing integrated circuit components, such as capacitor 46, monolithic amplifier 42, and a capacitor 48 in combination with an inductor 50. In this case the various components are preferably connected with wire bonding 40, although within the scope of the invention the components inside the module may be connected together by any known technique.

The joint between the coaxial cable 12 and module 10 shown in FIG. 2 may be duplicated at the other end of the module 10 as well, so that the module 10 will form a connectorless joint with coaxial cable at both ends.

FIG. 5 is a general view of a multiple connection of two modules 10 and 10*a*, showing how different modules may be combined for specific purposes. Various modules 10 may be manufactured having different configurations and combinations of electronic components therein, and then combined as necessary for the specific application. Each module may be hermetically sealed with the structure shown in FIG. 2 arranged symmetrically at both ends of the module 10. Such a module would thus accept coaxial cable 12 from both ends.

In many instances, the electronic components inside the cavity 36 of the hermetic module 10 will be active components; that is, they will require an external source of voltage or current in order to operate. This external source of power is distinguished from the signal which enters the hermetic module 10 through the coaxial cable 12 and typically through the center conductor 30 of the coaxial cable 12. The external voltage or current may be used as a power source for the active components, such as an operational amplifier, or as a source of performance control. In most cases the voltage or current must be supplied via a separate conductor member, which must also form a hermetic seal with the inner cavity 36. FIG. 6 shows an alternate embodiment 10' of the present invention, having a "bias feedthrough" means in addition to the recess for accepting the coaxial cable 12. The bias feedthrough includes a second conductor member 100, having a first end 102 disposed external of the module 10', and a second end 104, which is disposed within the cavity 36'. The first end 102 may be of any particular shape to accommodate any type of external connection. Second end 104 may be connected, by a wire bond 106 or other means, to any number of active components such as 108 inside cavity 36'.

Second conductor member 100 of the bias feedthrough is, like the conductor member 22 for the coaxial cable, hermetically sealed within a recess of the body member 18' by second sealing member 110. Second sealing member 110 is made of a material such as ceramic or glass, and seals the cavity 36' between the second conductor member 100 and the body member 18'. In the preferred embodiment, the second conductor member 100 may, but need not, be captivated.

The connectorless joint formed between the module 10 and the coaxial cable 12 provides an interface which allows the electronic components inside the module 10 to be hermetically sealed within the module, without adding the excess weight or requiring the extra space associated with discrete microwave connectors. Also, the invention provides an interface between the coaxial cable and the electronic components in the module which may be easily modified by replacing the module when an upgrade of a system is required.

The present invention may be embodied in other specific forms without departing from the spirit or essential attributes thereof and, accordingly, reference should be made to the appended claims, rather than to the foregoing specification, as indicating the scope of the invention.

I claim:

1. A hermetic module for housing at least one electronic component, integrated with a coaxial cable having a center conductor and an outer conductor, comprising:

a housing, defining at least one opening and an interior space therein;

a conductive body member disposed around the interior surface of the housing within the interior space and defining a recess and a cavity therein for containing at least one electronic component, said recess being in registration with the opening in the housing and receiving an end of a coaxial cable inserted into the recess, the interior walls of the recess forming an electrical contact for the outer conductor of the coaxial cable;

a conductor member, having a first end disposed in the recess for mating with the center conductor of the coaxial cable inserted into the recess of the body member and a second end disposed in the cavity;

a sealing member disposed around the conductor member and forming a hermetic seal between the recess and the cavity; and means for operatively connecting the at least one electronic component in the cavity to the second end of the conductor member.

2. A module as in claim 1, wherein the sealing member is made of ceramic, and the conductor member is captivated within the sealing member.

3. A module as in claim 1, wherein the recess defines at least two regions of different inner diameters, comprising a first region defining a diameter for accommodating the outer diameter of the coaxial cable, and a second region of a diameter smaller than the diameter of the first region, the two regions forming a shoulder therebetween.

4. A module as in claim 1, wherein the outside diameter of the first end of the conductor member and the inner diameter of the recess near the first end of the conductor member are dimensioned to form an air dielectric coaxial transmission line of a predetermined characteristic impedance.

5. A hermetic module for housing at least one electronic component, integrated with a coaxial cable having a center conductor and an outer conductor, comprising:

a housing, defining at least one opening and an interior space therein;

a conductive body member disposed within the housing and defining a recess and a cavity therein, the recess defining at least two regions of different, inner diameter, a first region defining a diameter for accommodating the outer diameter of a coaxial cable and to form an electrical contact with the outer conductor of the coaxial cable, and a second region of a diameter smaller than the first region, the two regions forming a shoulder therebetween;

a conductor member, having a first end, disposed in the second region of the recess for mating with the center conductor of the coaxial cable inserted into the recess of the body member, and a second end disposed in the cavity, and the outer diameter of the conductor member at the first end and the inner diameter of the second region of the recess being dimensioned to form an air dielectric coaxial transmission line of a predetermined characteristic impedance;

a ceramic sealing member forming a hermetic seal between the recess and the cavity and having the conductor member captivated within the sealing member; and means for operatively connecting the second end of the conductor member to the at least one electronic component contained in the cavity.

6. A hermetic module for housing at least one electronic component, integrated with a coaxial cable having a center conductor and an outer conductor, comprising:

a housing, defining at least one opening and an interior space therein;

a conductive body member disposed within the housing and defining a first recess, a second recess, and a cavity therein for containing the at least one electronic component, the first and second recesses being in registration with the at least one opening in the housing, the first recess receiving an end of a coaxial cable inserted therein, the interior walls of the first recess forming an electrical contact for the outer conductor of the coaxial cable;

a first conductor member, having a first end disposed within the first recess for mating with the center conductor of the coaxial cable inserted into the first recess, and a second end disposed in the cavity;

a second conductor member, disposed in the second recess and having a first end exposed external to the module and a second end disposed within the cavity;

a first sealing member disposed around the first conductor member and forming a hermetic seal between the first recess and the cavity;

a second sealing member disposed around the second conductor member and forming a hermetic seal between the outside of the module and the cavity; and means for operatively connecting a selected one of the at least one electronic component in the cavity to the second end of the first conductor member and any one of the at least one electronic component to the second end of the second conductor member.

* * * * *